US007242360B2

(12) United States Patent
Wu et al.

(10) Patent No.: US 7,242,360 B2
(45) Date of Patent: Jul. 10, 2007

(54) HIGH POWER DUAL BAND HIGH GAIN ANTENNA SYSTEM AND METHOD OF MAKING THE SAME

(75) Inventors: Te-Kao Wu, Rancho Palos Verdes, CA (US); George M. Haney, Redondo Beach, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 54 days.

(21) Appl. No.: 11/273,070

(22) Filed: Nov. 14, 2005

(65) Prior Publication Data

US 2007/0109212 A1 May 17, 2007

(51) Int. Cl.
*H01Q 13/00* (2006.01)

(52) U.S. Cl. ..... 343/781 CA; 343/779; 343/781 P

(58) Field of Classification Search ..... 343/776, 343/779, 781 P, 781 CA
See application file for complete search history.

(56) References Cited

U.S. PATENT DOCUMENTS 3,394,378 A * 7/1968 Williams et al. ..... 343/779
4,562,441 A 12/1985 Beretta et al.
5,025,485 A 6/1991 Csongor et al.
5,373,302 A * 12/1994 Wu ..... 343/781 P
6,107,973 A * 8/2000 Knop et al. ..... 343/781 P
6,184,840 B1 * 2/2001 Hsin-Loug et al. ..... 343/781 P
6,271,799 B1 * 8/2001 Rief et al. ..... 343/776
6,424,312 B2 * 7/2002 Mangenot et al. ..... 343/840
6,504,514 B1 1/2003 Toland et al.
6,680,711 B2 * 1/2004 Desargant et al. .... 343/781 CA
6,741,216 B2 * 5/2004 Inasawa et al. ..... 343/754
6,774,861 B2 8/2004 Choung et al.
6,911,953 B2 * 6/2005 Gothard et al. ..... 343/781 CA
6,937,201 B2 8/2005 Gothard et al.

* cited by examiner

*Primary Examiner*—Hoang V. Nguyen
(74) *Attorney, Agent, or Firm*—Tarolli, Sundheim, Covell & Tummino LLP

(57) ABSTRACT

A high power dual band high gain antenna system is provided. The antenna system employs one or more feedhorn clusters to distribute power associated with the transmission of high power signals. A first feedhorn cluster is associated with a first frequency band and a second feedhorn cluster is associated with a second frequency band that operates in frequencies below the first frequency band. The antenna system includes a sub-reflector and a main reflector with a first focal point of the sub-reflector being substantially aligned with a focal point of the main reflector. The first feedhorn cluster and the second feedhorn cluster are arranged on a surface of the main reflector with radiating aperture phase centers substantially aligned with a second focal point of the sub-reflector.

20 Claims, 4 Drawing Sheets

HIGH POWER DUAL BAND HIGH GAIN ANTENNA SYSTEM AND METHOD OF MAKING THE SAME

This invention was made with Government support under Contract No. NM071041 awarded by National Aeronautics and Space Administration. The Government has certain rights in this invention.

TECHNICAL FIELD

Background

Deep space exploration satellite systems require high power, high gain antenna systems for transmitting data from the satellite back to a ground station located on the Earth. For example, the United States (US) National Aeronautics and Space Administration (NASA) is planning the development and launching of a Jupiter Icy Moons Orbiter (JIMO) to explore the nature and extent of habitable environments in the solar system. One of the main objectives of such a mission is to detect and analyze a wide variety of chemical species, including chemical elements, salts, minerals, organic and inorganic compounds, and possible biological compounds, in the surface of Jupiter's icy moons. The data collected needs to be transmitted over a dual band (e.g., Ka/X-band, Ka/S-band) at a high data rate. However, current antenna systems employed in satellites do not provide the desired antenna gain for transmitting data over dual microwave frequency bands at desired data rates, or can handle the amount of power necessary to transmit data over dual microwave frequency bands at desired data rates.

SUMMARY

In one aspect of the invention, an antenna system is provided that comprise a main reflector having a parabolic dish shape with a concave reflective surface and a hyperbolic sub-reflector disposed above and spaced apart from the concave reflective surface of the main reflector a sub-reflector disposed above and spaced apart from the concave reflective surface of the main reflector with a first focal point aligned with a focal point of the main reflector. The antenna system further comprises a first feedhorn cluster that includes a plurality of first set of feedhorns operative to transmit and receive radio frequency signals within a first frequency band. The first feedhorn cluster extends through the concave reflective surface of the main reflector with its radiating aperture's phase center substantially aligned with the second focal point of the sub-reflector. The antenna system further comprises a second feedhorn cluster that includes a plurality of second set of feedhorns operative to transmit and receive radio frequency signals within a second frequency band. The second feedhorn cluster extends through the concave reflective surface of the main reflector with its radiating aperture's phase center substantially aligned with the second focal point of the sub-reflector.

In another aspect of the invention, an antenna system for a satellite is provided. The system comprises a main reflector having a parabolic dish shape with a concave reflective surface and a hyperbolic sub-reflector disposed above and spaced apart from the concave reflective surface of the main reflector with a first focal point of the sub-reflector substantially aligned with the focal point of the main reflector. The system further comprises a first feedhorn cluster that includes seven circular feedhorns with a central feedhorn and six outer feedhorns disposed around the periphery of the central feedhorn in a generally hexagonal arrangement. Each of the seven circular feedhorns are operative to transmit and receive radio frequency signals within a first frequency band. The first feedhorn cluster extends through the concave reflective surface with its radiating aperture's phase center substantially aligned with a second focal point of the sub-reflector, wherein each of the seven circular feedhorns distribute the total power of an output signal through spatial combining of the plurality of feedhorns. The system further comprises a second feedhorn cluster that includes five circular feedhorns with a central feedhorn and four outer receive feedhorns arranged in a generally X shaped configuration to provide the azimuth and elevation difference signals for tracking the Earth. The center feed is operative to transmit and receive radio frequency signals within a second frequency band. The second feedhorn cluster extends through the concave reflective surface of the main reflector with its radiating aperture's phase center substantially aligned with the second focal point of the sub-reflector, wherein the first frequency band includes frequencies greater than frequencies in the second frequency band.

In yet another aspect of the invention, a method for forming an antenna system is provided. The method comprises arranging a plurality of first feedhorns operative to transmit and receive radio frequency signals within a first frequency band as a first feedhorn cluster that provides for power distribution for receiving and transmitting signals within the first frequency band, and arranging a plurality of second feedhorns operative to transmit and receive radio frequency signals within a second frequency band as a second feedhorn cluster that provides for power distribution for receiving and transmitting signals within the second frequency band. The method further comprises locating the radiating aperture's phase center of the first feedhorn cluster at a surface of a main reflector substantially aligned with a second focal point of a sub-reflector that is spaced apart from a concave reflective surface of the main reflector. The sub-reflector is disposed above and spaced apart from the concave reflective surface of the main reflector with a first focal point of the sub-reflector substantially aligned with a focal point of the main reflector. The method also comprises locating the radiating aperture's phase center of the second feedhorn cluster at the surface of the main reflector substantially aligned with the second focal point of the sub-reflector and spaced apart from the first feedhorn cluster.

DETAILED DESCRIPTION

Figure 1:
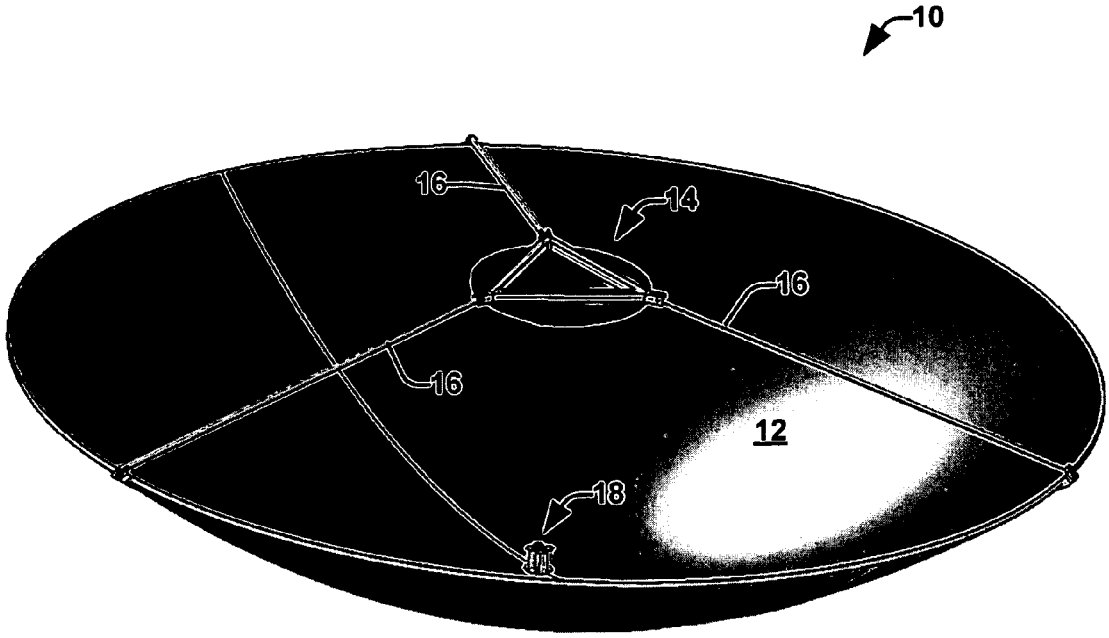
FIG. 1 illustrates a perspective view of an antenna system in accordance with an aspect of the present invention.

The present invention relates to a high power dual band high gain antenna system. The antenna system employs one or more feedhorn clusters to distribute power associated with the transmission of high power signals (e.g., 500–3000 watts). A first feedhorn cluster is associated with a first frequency band and a second feedhorn cluster is associated with a second frequency band that operates in frequencies below the first frequency band. The antenna system includes a sub-reflector and a main reflector having aligned focal points. The first feedhorn cluster and the second feedhorn cluster are arranged on the main reflector with respective radiating phase centers aligned with a second focal point of the sub-reflector.

For deep space communication system, the transmitted RF power requirement is high, which is typically produced from a single TWT (Traveling Wave Tube) source. A single power source is susceptible to a single point failure, which is not desirable. Additionally, a single waveguide and antenna will have to be substantially large for handling high power transmit signals, such as 1000 watts. The larger antenna will take up additional space, for example, in a main reflector reducing the gain and reliability of the antenna. To improve the reliability of the communication system, multiple TWTs can be employed utilizing the feedhorn clusters of the present invention, which will allow a graceful degradation in the case of a failed source, as opposed to a single point failure in addition to providing a compact low loss solution at microwave frequency bands and millimeter wave frequency bands.

In one aspect of the invention, the first and second feedhorn clusters are arranged such that feedhorns of the second feedhorn cluster are disposed around the feedhorns of the first feedhorn cluster, such that both the first and second feedhorn clusters having radiating phase centers substantially aligned with a focal point of the sub-reflector.

In another aspect of the invention, the sub-reflector is comprised of a first frequency selective surface (FSS) operative to reflect frequencies of the first frequency band and to pass frequencies of the second frequency band, and a second FSS operative to reflect frequencies of the second frequency band and to pass frequencies of the first frequency band. The first FSS is bonded to the second FSS, such that an angle is formed between the first FSS and second FSS. Therefore, the first FSS and second FSS are tilted with respect to one another allowing for a radiating phase center of a first feedhorn cluster to be aligned with a focal point of the first FSS and a radiating phase center of a second feedhorn cluster to be aligned with a focal point of the second FSS. This allows spacing between the first feedhorn cluster and the second feedhorn cluster along the main reflector.

In yet another aspect of the invention, a first frequency selective surface (FSS) operative to pass frequencies of the first frequency band and to reflect frequencies of the second frequency band is disposed between a first feed arrangement and a second focal point of a solid hyperbolic sub-reflector, and a second FSS operative to reflect frequencies of the second frequency band is disposed above a second feed arrangement. The first FSS has a flat circular shape and is tilted at about a 45° angle with respect to the focal axis of the hyperbolic sub-reflector. The second FSS has an ellipsoidal shape, such that one of the focal points of the two focal points of the ellipsoid is aligned with a radiating phase center of the second feed arrangement and a second focal point is aligned with the second focal point of the sub-reflector through the first FSS. That is signals within the second frequency band are reflected by the first FSS, the second FSS, the sub-reflector and a main reflector.

The term "radio frequency signals" as employed herein is meant to include both a radio frequency signal in an alternating current and voltage state and an electromagnetic field state in the form of electromagnetic wave patterns, and is further meant to include radio frequency signals covering a significant portion of the electromagnetic radiation spectrum (e.g., from about nine kilohertz to several thousand GHz).

FIG. 1 illustrates an antenna system 10 in accordance with an aspect of the present invention. The antenna system 10 can be employed in deep space exploration satellite systems that require high power, high gain antenna systems for transmitting data from the satellite back to a ground station located on the Earth at a substantially high data rate. The antenna system 10 includes a main reflector 12 that can be a parabolic shaped dish with a concave reflective surface with a substantially large diameter (e.g., about 3 meters) and a substantially smaller diameter hyberbolic shaped sub-reflector 14 disposed in a space apart relationship from the main reflector 12 via support rods 16, such that a first focal point of the sub-reflector 14 is substantially aligned with a focal point of the main reflector 12. The main reflector 12 and the sub-reflector 14 can be formed of a metallic honeycomb material such as aluminum or other reflective material.

The antenna system 10 also includes a feedhorn cluster arrangement 18 that extends from an antenna feed system (not shown) through the surface of the main reflector 12 with the shortest waveguide connection to the RF components, such as the TWTAs and switches (e.g., which can be housed in a shielded compartment box placed right behind the main reflector to avoid excessive transmission power loss). A radiating aperture's phase center of the feedhorn cluster arrangement 18 is substantially aligned with a second focal point of the sub-reflector 18. The feedhorn cluster arrangement 18 includes a square feedhorn cluster with a plurality of square feedhorns operative to transmit and receive radio frequency signals within a first frequency band (e.g., Ka band) surrounded by a second feedhorn cluster with a plurality of feedhorns operative to transmit and receive radio frequency signals within a second frequency band (e.g., X band).

Figure 2:
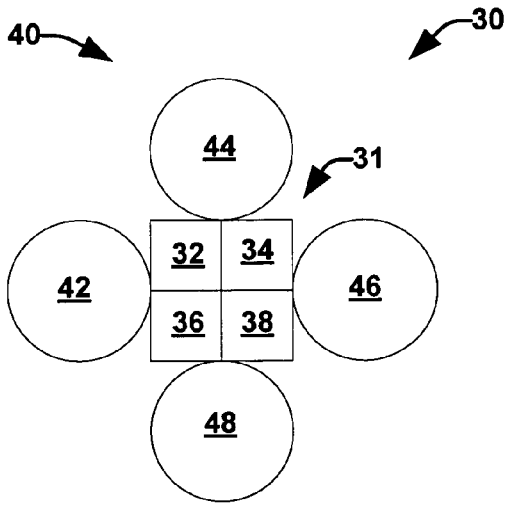
FIG. 2 illustrates a top schematic view of a radiating aperture end of a feedhorn cluster arrangement in accordance with an aspect of the present invention.

FIG. 2 illustrates a radiating aperture end of a feedhorn cluster arrangement 30 in accordance with an aspect of the present invention. The feedhorn cluster arrangement 30 can be employed in the antenna system 10 of FIG. 1. The feedhorn cluster arrangement 30 includes a first feedhorn cluster 31 formed from four square feedhorns 32, 34, 36 and 38 arranged in an integral square arrangement operative to transmit and receive radio frequency signals in a first frequency band. The feedhorn cluster arrangement 30 includes a second feedhorn cluster 40 formed from four circular feedhorns 42, 44, 46 and 48 operative to transmit and receive radio frequency signals in a second frequency band, such that the first frequency band includes frequencies greater than frequencies of the second frequency band.

In one aspect of the invention, the first frequency band comprises frequencies operating in the Ka band (e.g., about 26 gigahertz to about 40 gigahertz) and the second band comprises frequencies operating in the X band (e.g., about 8 gigahertz to about 12 gigahertz). It is to be appreciated that the plurality of square feedhorns 32, 34, 36 and 38 can be replaced with a plurality of circular feedhorns, or hexagonal feedhorns to provide a desired circular polarization. Additionally, the plurality of circular feedhorns 42, 44, 46 and 48 can be replaced with a plurality of square feedhorns, or hexagonal feedhorns to provide a desired circular polarization. However, these configurations may result in a larger footprint than the feedhorn cluster arrangement 30.

The plurality of square feedhorns 32, 34, 36 and 38 are operative to be coupled to respective waveguides that receive a plurality of in-phase input signals, each having a respective power, from respective traveling wave tube amplifiers (TWTAs), such that an output signal is provided from the feedhorn cluster 31 having a power substantially equal to the sum of the respective powers of the plurality of in-phase input signals. Therefore, the total power of the output signal is distributed through spatial combining of feedhorns. In this manner, the size of the feedhorns 32, 34, 36 and 38 and respective waveguides can be scaled down in size as opposed to employing a single feedhorn that can handle the total power of the output signal. Additionally, the use of multiple feedhorns in a cluster allows there to be more than a single point of failure with respect to the TWTAs driving the signals through the feedhorns.

The plurality of circular feedhorns 42, 44, 46 and 48 are operative to receive a plurality of in-phase input signals from respective traveling wave tube amplifiers (TWTAs) each having a respective power, for example, through waveguides and respective rectangular-to-circular transitions, such that an output signal is provided from the four circular feedhorn cluster having a power substantially equal to the sum of the respective powers of the plurality of in-phase input signals. Furthermore, the plurality of four circular feedhorns can provide different channels and/or functions, i.e., tracking the location of Earth, such that communication between a satellite system and a ground station can be maintained in addition to transmitting and receiving data communications. The plurality of four circular feedhorns 42, 44, 46 and 48 are packed close to the integral square arrangement, such that a single circular feedhorn is disposed adjacent and substantially centered on each side of the integral square arrangement to provide a compact footprint.

Figure 3:
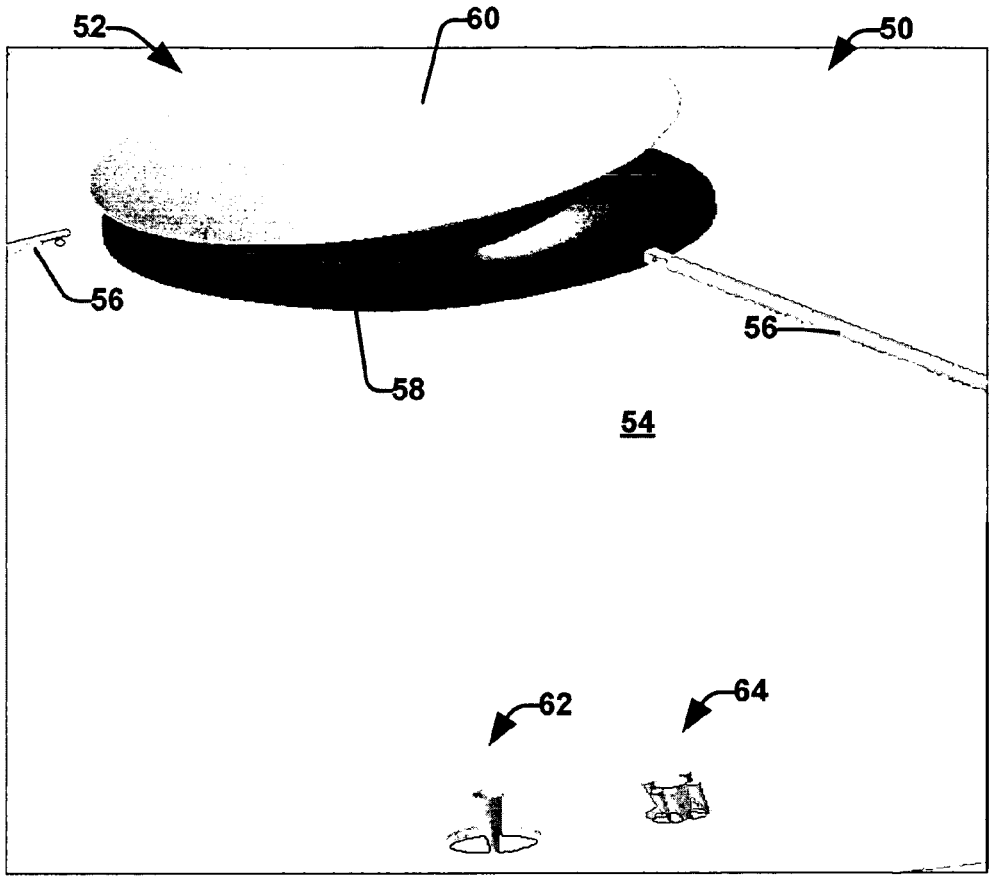
FIG. 3 illustrates a perspective view of an antenna system employing a dual surface sub-reflector in accordance with an aspect of the present invention.

FIG. 3 illustrates an antenna system 50 employing a dual surface sub-reflector 52 in accordance with an aspect of the present invention. The antenna system 50 can also be employed in deep space exploration satellite systems that require high power, high gain antenna systems for transmitting data from the satellite back to a ground station located on the Earth at a substantially high data rate. The antenna system 50 includes a main reflector 54 that can be a parabolic shaped dish with a concave reflective surface with a substantially large diameter and the substantially smaller diameter dual surface solid sub-reflector 52 disposed in a spaced apart relationship from the main reflector 54 via support rods 56. The dual surface sub-reflector 52 includes a front frequency selective surface (FSS) 58 and a back (FSS) 60. The front FSS 58 and the back FSS 60 can both have hyperbolic shapes, such as the sub-reflector 14 illustrated in FIG. 1. A first focal point of the front FSS 58 is substantially aligned with a focal point of the main reflector 54, and a first focal point of the back FSS 60 is substantially aligned with the focal point of the main reflector 54.

The front FSS 58 and the back FSS 60 are bonded together via a dielectric honeycomb material, such as those available under the tradename Kevlar from E. I. DuPont de Nemours and Company of DELAWARE, to allow for an angle to be formed between portions of the front FSS 58 and the back FSS 60, such that one of the front FSS 58 and back FSS 60 is tilted at an angle with respect to the other. For example, the front FSS 58 and the back FSS 60 can be bonded together at respective ends to form the angle. Alternatively, the amount of dielectric honeycomb material can be built up more on first ends of the front FSS 58 and back FSS 60, and less on second ends of the front FSS 58 and back FSS 60.

The front FSS 58 is formed of a frequency selective material that reflects frequencies within a first band and passes frequencies outside the first band. The back FSS 60 is formed of a frequency selective material that reflects frequencies within a second band and passes frequencies outside the second band. In one aspect of the invention, the first frequency band is selected as the Ka band, such that the front FSS reflects frequencies within the first band, but allows frequencies within the second band to pass through the front FSS 58. The second frequency band is selected as the X band, such that the back FSS 60 reflects frequencies within the second band, but allows frequencies within the first band to pass through the back FSS 60.

The tilting of the back FSS 60 with respect to the front FSS 58 allows for providing a second focal point associated with the front FSS 58 along a first focal axis and a second focal point associated with the back FSS 60 along a second focal axis that is different than the first focal axis. Therefore, a first feedhorn cluster 62 that transmits and receives frequencies within the first frequency band can be aligned with a second focal point associated with the front FSS 58, and a second feedhorn cluster 64 that transmits and receives frequencies within the second frequency band can be aligned with the second focal point associated with the back FSS 60 to avoid the physical interference of the two above mentioned feed clusters and to maximize gain and mitigate spill over.

The first feedhorn cluster 62 extends from a first antenna feed system (not shown) through the surface of the main reflector 54 in a location that aligns a radiating aperture's phase center of the first feedhorn cluster 62 with the second focal point of the first FSS 58, and the second feedhorn cluster 64 extends from a second antenna feed system (not shown) through the surface of the main reflector 54 in a location that aligns the radiating aperture's phase center of the second feedhorn cluster 64 with a second focal point of the second FSS 60. The first feedhorn cluster 62 comprises a plurality of circular feedhorns configured in an integral arrangement. The first feedhorn cluster 62 is operative to provide an output signal within the first frequency band that has a power substantially equal to the sum of the power output from each individual circular feedhorn. Therefore, the total power of the output signal is distributed through spatial combining of feedhorns.

The second feedhorn cluster 64 comprises a plurality of feedhorns configured in an integral arrangement. The second feedhorn cluster 64 is operative to provide an output signal within the second frequency band that has a power substantially equal to the sum of the power output from each individual feedhorn. Alternatively, the second feedhorn cluster 64 can include a plurality of feedhorns (e.g., four) spaced around a larger center feed antenna that is employed for tracking purposes (e.g., monopulse tracking). In the example of FIG. 3, the second feedhorn cluster 64 includes four circular feedhorns spaced around a larger circular feedhorns as is used in satellite systems employing an X-band frequency band. It is to be appreciated that the first feedhorn cluster 62 and second feedhorn cluster 64 can be interchanged, and/or the tilting of the front FSS 58 and back FSS 60 can be modified as long as a given feedhorn is aligned with a second focal point of an associated FSS.

Figure 4:
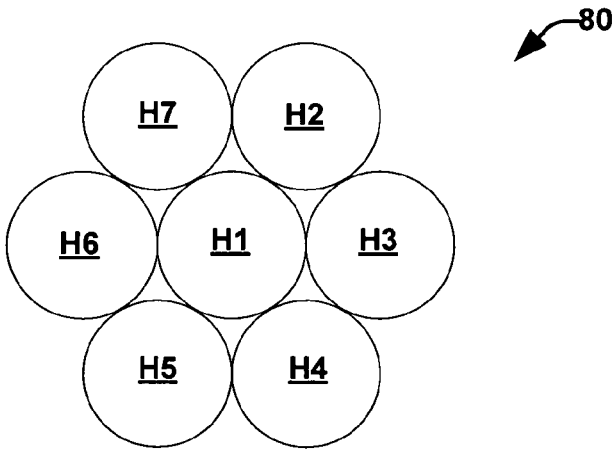
FIG. 4 illustrates a top schematic view of a radiating aperture end of a conical feedhorn cluster in accordance with an aspect of the present invention.

FIG. 4 illustrates a radiating aperture end of a circular feedhorn cluster 80 in accordance with an aspect of the present invention. The circular feedhorn cluster 80 can be employed as the first feedhorn cluster 62 illustrated in FIG. 3. The circular feedhorn cluster 80 includes seven circular feedhorns H1–H7 with a central feedhorn H1 and six feedhorns H2–H7 spaced around the central feedhorn H1 in a hexagonal arrangement. The circular feedhorn cluster 80 is operative to provide an output signal within a frequency band that has a power substantially equal to the sum of the power output from each individual circular feedhorn, such that power is distributed substantially evenly through each individual circular feedhorn. Alternatively, power can be distributed such that pairs of feedhorns are coupled in parallel, such that one feedhorn and three pairs of feedhorn distribute substantially the same power. For example, the central feedhorn H1 can receive an in-phase signal of about 250 watts, with each other pair of feedhorns receiving an in-phase signal of about 250 watts, such that the total power of the output signal is transmitted at about 1000 watts.

Figure 5:
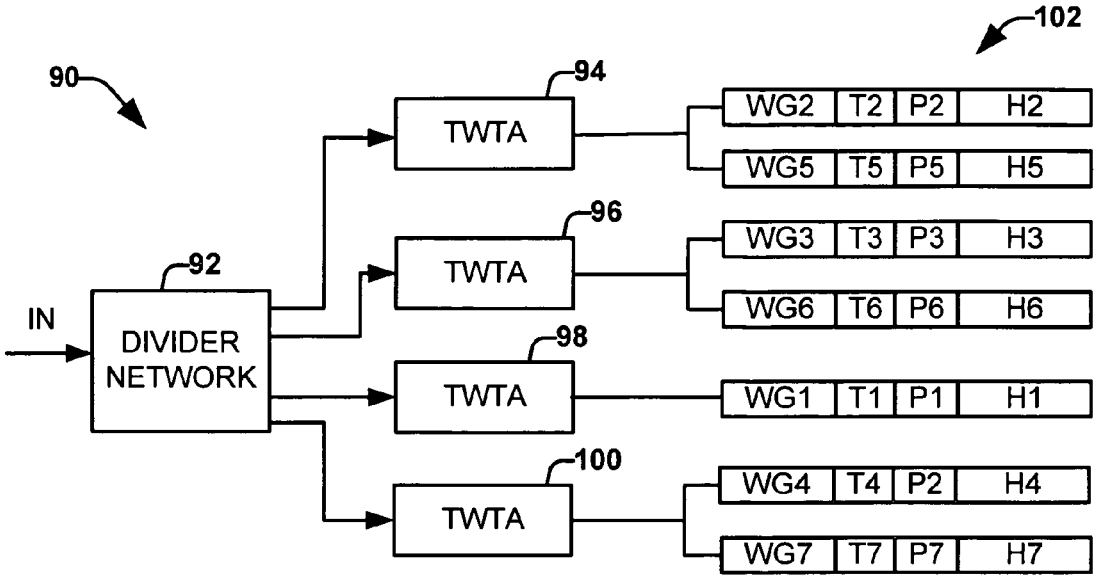
FIG. 5 illustrates a schematic view of an antenna transmitter feed system employing the conical feedhorn cluster of FIG. 4.

FIG. 5 illustrates an antenna transmitter feed system 90 employing the feedhorn cluster 80 of FIG. 4. The system 90 can be employed as part of a satellite system and includes a divider network 92 that receives an input signal for transmission. The divider network 92 divides the input signal into four in-phase signals of substantially equal power. The four in-phase signals are provided to respective traveling wave tube amplifiers (TWTAs) 94, 96, 98 and 100. The TWTAs 94, 96, 98 and 100 amplify the four in-phase signals to provide four in-phase signals of substantially equal power (e.g., 250 watts) to an antenna feed system 102. A first TWTA 94 is coupled to both a feedhorn H2 and feedhorn H5. The first TWTA 94 provides a first in-phase signal, which is divided to provide respective half power (e.g., 125 watts) in-phase signals to both the feedhorn H2 and the feedhorn H5.

A second TWTA 96 is coupled to both a feedhorn H3 and a feedhorn H6. The second TWTA 96 provides a second in-phase signal, which is divided to provide respective half power (e.g., 125 watts) in-phase signals to both the feedhorn H3 and the feedhorn H6. A third TWTA 98 is coupled to a feedhorn such that the third TWTA 98 provides a third in-phase signal of a given power (e.g., 250 watts) to the feedhorn H1. A fourth TWTA 100 is coupled to both a feedhorn H4 and a feedhorn H7. The fourth TWTA 100 provides a second in-phase signal, which is divided to provide respective half power (e.g., 125 watts) in-phase signals to both the feedhorn H4 and the feedhorn H7. Each of the feedhorns H1–H7 are operative to handle signals having a power of about 250 watts. Each of the feedhorns H1–H7 are coupled to the above TWTAs via respective waveguides WG1–WG7, rectangular-to-circular transitions T1–T7, and polarizers P1–P7 as illustrated in FIG. 5.

Arranging the feedhorns H1–H7 in the arrangement illustrated in FIG. 4, provides for a feedhorn cluster 80 that transmits an output signal that is a combination of the output signals from each of the seven feedhorns, such that the total transmission power of the output signal is the sum of the power (e.g., 1000 watts) of each of the output signals transmitted from the respective feedhorns H1–H7. The seven-feedhorn arrangement 80 provides for a compact footprint that allows power distribution over the feedhorns to mitigate arcing and an improved antenna gain when aligned with a focal point of a respective sub-reflector. It is to be appreciated that the example of the antenna transmitter feed system is not limited to the above arrangement but could include a variety of different arrangements for distributing power over the feedhorn cluster. It is also to be appreciated that the feedhorn cluster can include more or less circular feedhorns with different geometrical configurations.

Figure 6:
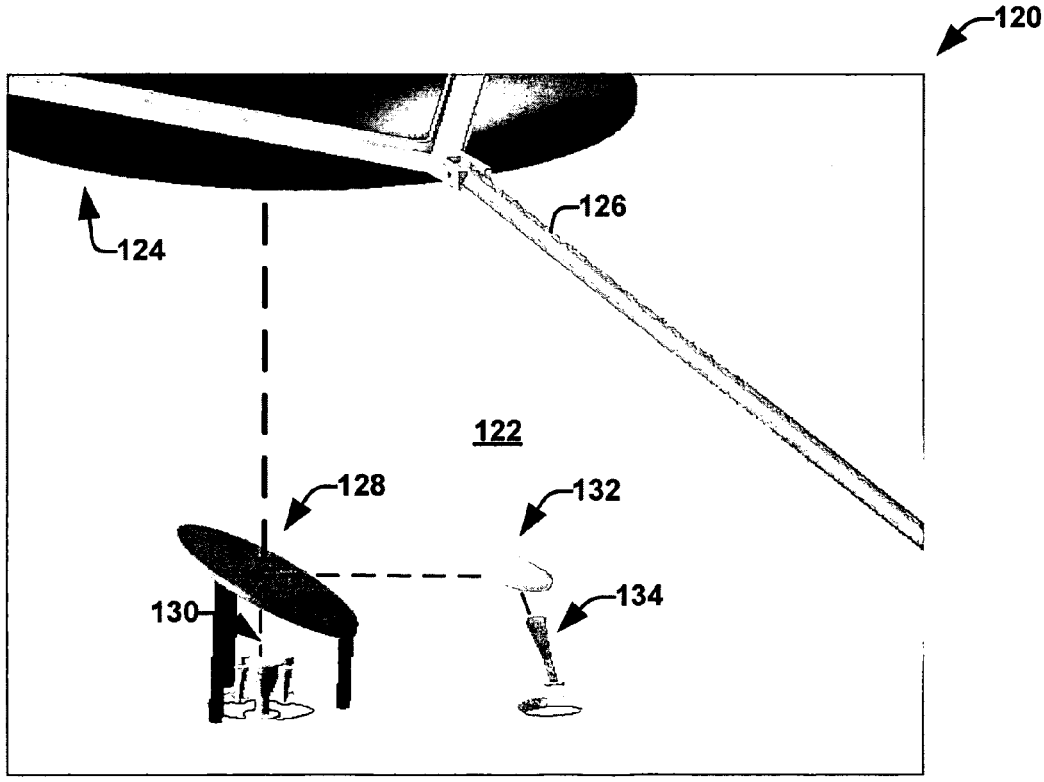
FIG. 6 illustrates a perspective view of an antenna system employing multiple frequency selective surfaces in accordance with an aspect of the present invention.

FIG. 6 illustrates an antenna system 120 employing multiple frequency selective surfaces in accordance with an aspect of the present invention. The antenna system 120 can also be employed in deep space exploration satellite systems that require high power, high gain antenna systems for transmitting data from the satellite back to a ground station located on the Earth at a substantially high data rate. The antenna system 120 includes a main reflector 122 that can be a parabolic shaped dish with a concave reflective surface with a substantially large diameter and a substantially smaller diameter solid sub-reflector 124 disposed in a spaced apart relationship from the main reflector via support rods 126.

The sub-reflector 124 has a generally parallel parabolic shape with a first focal point aligned with the focal point of the main reflector. A first FSS 128 is disposed between a first feedhorn cluster 130 and the sub-reflector 124. The first FSS 128 is formed of a frequency selective material that allows the passing of frequencies within a first band and reflects frequencies outside the first band. The first FSS 128 has a flat circular shape and is placed between the feed cluster 130 and the sub-reflector 124 and is tilted at about a 45° angle with respect to the focal axis of the sub-reflector 124. The first feedhorn cluster 130 extends from a first antenna feed system (not shown) through the surface of the main reflector 122 with its radiating aperture's phase center aligned with a second focal point of the sub-reflector 124.

A second FSS 132 is disposed amongst the first FSS 128, a second feedhorn cluster 134 and the sub-reflector 124. The second FSS 132 is formed of a frequency selective material that reflects frequencies within a second frequency band and passes frequencies outside the second frequency band. The second FSS 132 has an ellipsoidal shape, such that the second FSS 132 has two focal points. In this arrangement, one of the focal points (e.g., the virtual (or image) focal point) of the second FSS 132 can be aligned with the first FSS. 128 to reflect signals within the second frequency band to the second focal point of the sub-reflector 124. The second feedhorn cluster 134 extends from a second antenna feed system (not shown) through the surface of the main reflector 122 with its aperture's phase center of the second feedhorn cluster 134 aligned with a second focal point of the second FSS 132.

As illustrated by the dashed lines in FIG. 6, a transmission signal within the second frequency band from the second feedhorn cluster 134 is transmitted to the second FSS 132, reflected from the second FSS 132 to the first FSS 128, reflected from the first FSS 128 to the sub-reflector 124, reflected from the sub-reflector 124 to the main reflector 122 and reflected from the main 122 reflector to the desired destination (e.g., Earth). A signal within the second frequency band from a destination that is provided to the main reflector 122 is reflected to the subreflector 124, which reflects the signal to the first FSS 128, the first FSS 128 reflects the signal to the second FSS 132, which reflects the signal to the second feedhorn cluster 134.

A transmission signal within the first frequency band from the first feedhorn cluster 134 is transmitted through the first FSS 128, reflected from the sub-reflector 124 to the main reflector 122 and reflected from the main reflector 122 to the desired destination (e.g., Earth). A signal within the first frequency band from a destination that is provided to the main reflector 122 is reflected to the subreflector 124, which reflects the signal to the first FSS 128, which passes the signal to the first feedhorn cluster 130.

In one aspect of the invention, the first frequency band is selected as the X band, such that the first FSS passes frequencies within the first band, but reflects frequencies within the second band. The second frequency band is selected as the Ka band, such that the second FSS reflects frequencies within the second band, but passes frequencies outside the second band. It is to be appreciated that the use of a flat circular FSS and ellipsoidal FSS can be interchanged as long as the frequency selective material employed is selective to pass (or reflect) the desired frequency of the associated feedhorn and the flat circular FSS and ellipsoidal FSS are aligned in the appropriate manner.

Figure 7:
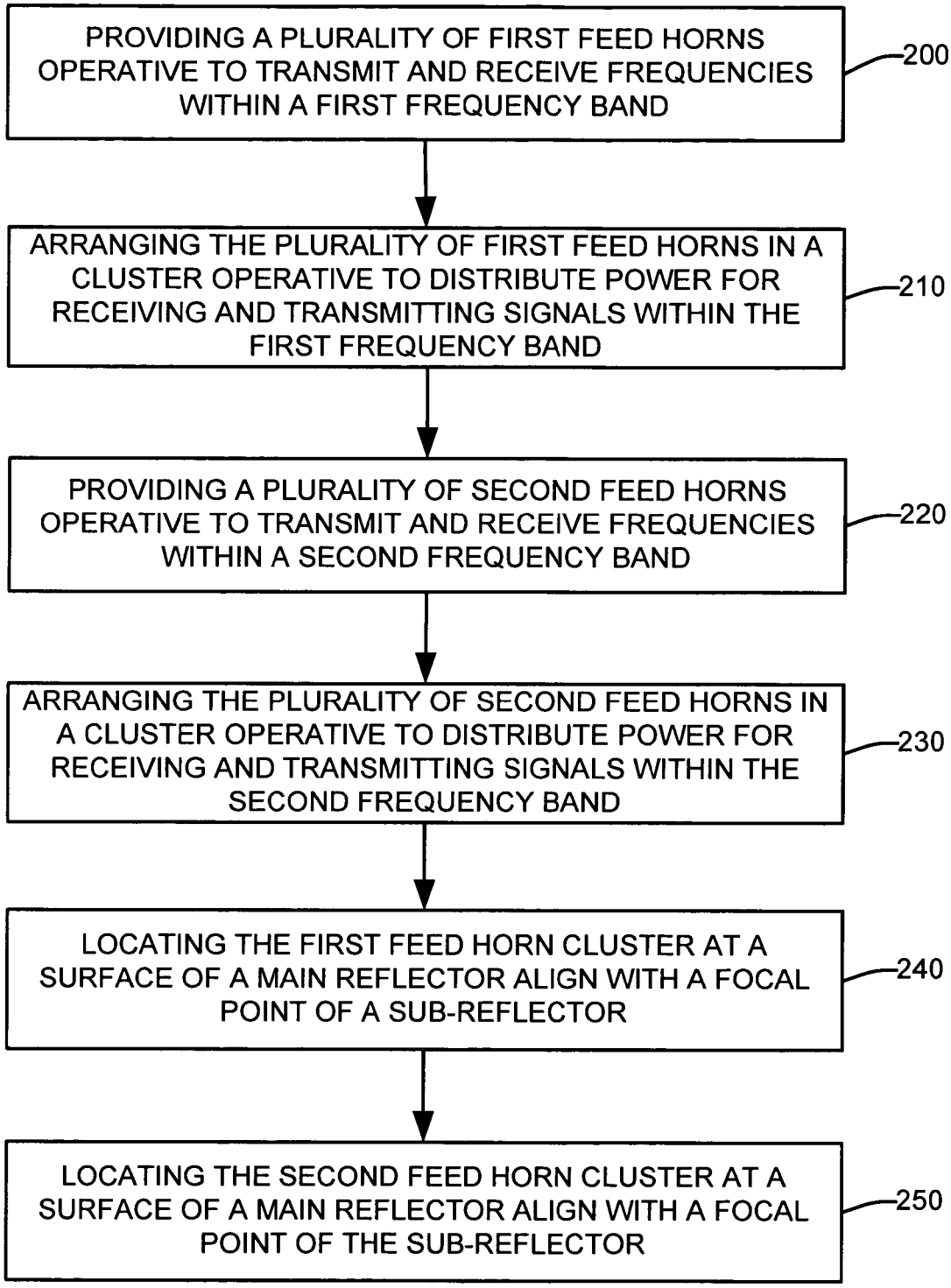
FIG. 7 illustrates a methodology for forming a dual band high power antenna system in accordance with an aspect of the present invention.

In view of the foregoing structural and functional features described above, a method will be better appreciated with reference to FIG. 7. It is to be understood and appreciated that the illustrated actions, in other embodiments, may occur in different orders and/or concurrently with other actions. Moreover, not all illustrated features may be required to implement a method. It is to be further understood that the following methodologies can be implemented in hardware (e.g., a computer or a computer network as one or more integrated circuits or circuit boards containing one or more microprocessors), software (e.g., as executable instructions running on one or more processors of a computer system), or any combination thereof.

FIG. 7 illustrates a methodology for forming a dual band high power antenna system in accordance with an aspect of the present invention. The methodology begins at 200 where a plurality of first feedhorns are provided that are operative to transmit and receive radio frequency signals within a first frequency band. At 210, the plurality of first feedhorns are arranged in a first feedhorn cluster that is operative to distribute power of the radio frequency signals within the first frequency band. For example, the feedhorns can receive respective in-phase input radio frequency signals of a given power at respective inputs and output a combined radio frequency signal of a power that is a sum of the power of the plurality of in-phase radio frequency signals. The employment of a feedhorn cluster as opposed to a single feedhorns provides for employment of feedhorns with less power handling capabilities in addition to mitigating problems associated with a single point of failure. The methodology then proceeds to 220.

At 220, a plurality of second feedhorns are provided that are operative to transmit and receive radio frequency signals within a second frequency band. At 230, the plurality of second feedhorns are arranged in a second feedhorn cluster that is operative to distribute power of the radio frequency signals within the second frequency band. For example, the feedhorns can receive respective in-phase input radio frequency signals of a given power at respective inputs and output a combined radio frequency signal of a power that is a sum of the power of the plurality of in-phase radio frequency signals. It is to be appreciated that one or more feedhorns of the first feedhorn cluster and/or the second feedhorn cluster can be employed to provide communication over a different channel than the data communication. Therefore, one or more feedhorns can employed for different functionality than data exchange, such as for a tracking function. The methodology then proceeds to 240.

At 240, the first feedhorn cluster is located at a surface of a main reflector with its radiating aperture's phase center aligned with a focal point of a sub-reflector. At 250, the second feedhorn cluster is located at a surface of a main reflector and aligned with a focal point of a sub-reflector. The first and second feedhorn clusters can be coupled to respective feed systems associated with a satellite communication payload. The feedhorns associated with the second feedhorn cluster can be disposed around the feedhorns of the first feedhorn cluster, such that both feedhorn clusters' phase centers are aligned with a focal point of the sub-reflector. Alternatively, the sub-reflector can be formed from a first FSS and second FSS being bonded together to form an angle therebetween, such that the first feedhorn cluster can be aligned with the focal point of the first FSS and the second feedhorn cluster aligned with the focal point of the second FSS. Furthermore, a first FSS having a flat circular shape can be disposed between the sub-reflector and the first feedhorn cluster, and a second FSS having an ellipsoidal shape can be disposed amongst the first FSS, the sub-reflector and the second feedhorn cluster. In this arrangement, the first feedhorn cluster is aligned with the focal point of the sub-reflector and the second feedhorn cluster is aligned with one of the two focal points of the second FSS and the other focal point of the second FSS is aligned with the focal point of the sub-reflector via the first FSS.

What have been described above are examples of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. An antenna system comprising:

a main reflector having a parabolic dish shape with a concave reflective surface;

a sub-reflector disposed above and spaced apart from the concave reflective surface of the main reflector with a first focal point aligned with a focal point of the main reflector;

a first feedhorn cluster that includes a plurality of first feedhorns operative to transmit and receive radio frequency signals within a first frequency band, the first feedhorn cluster extends through the concave reflective surface with its radiating aperture's phase center substantially aligned with a second focal point of the sub-reflector, wherein the plurality of first feedhorns distribute the total power of an output signal through spatial combining of the plurality of feedhorns; and a second feedhorn cluster that includes a plurality of second feedhorns operative to transmit and receive radio frequency signals within a second frequency band, the second feedhorn cluster extends through the concave reflective surface with its radiating aperture's phase center substantially aligned with the second focal point of the sub-reflector.

2. The system of claim 1, wherein the plurality of first feedhorns distribute the total power of an output signal through spatial combining of the plurality of feedhorns.

3. The system of claim 1, wherein the plurality of first feedhorns are four square feedhorns arranged in an integral square arrangement, and the plurality of second feedhorns are four circular feedhorns with each of a given circular feedhorn disposed adjacent a side of the integral square arrangement to form a feedhorn cluster arrangement with a radiating aperture's phase center aligned with the second focal point of the sub-reflector.

4. The system of claim 1, further comprising a plurality of traveling wave tube amplifiers (TWTAs) that provide respective in-phase input signals to one or more of the plurality of first feedhorns, the plurality of first feedhorns providing an output signal with a power that is a sum of the power of the respective in-phase input signals.

5. The system of claim 1, wherein the plurality of first feedhorns are seven feedhorns with a central feedhorn and six outer feedhorns disposed around the periphery of the central feedhorn in a generally hexagonal arrangement.

6. The system of claim 5, further comprising a first traveling wave tube amplifiers (TWTAs) that provides a first in-phase input signal to the central feedhorn, a second TWTA that provides a second in-phase input signal to a first and second feedhorn of the six outer feedhorns, a third TWTA that provides a third in-phase input signal to a third and fourth feedhorn of the six outer feedhorns, and a fourth TWTA that provides a fourth in-phase input signal to a fifth and sixth feedhorn of the six outer feedhorns.

7. The system of claim 1, wherein the sub-reflector is comprised of a first frequency selective surface operative to reflect RF signals within the first frequency band and a second FSS operative to reflect RF signals within the second frequency band, the first FSS is bonded to the second FSS to form an angle therebetween such that the first FSS is tilted relative to the second FSS.

8. The system of claim 7, wherein the radiating aperture's phase center of the first feedhorn cluster is substantially aligned with a focal point of the first FSS and the radiating aperture's phase center of the second feedhorn cluster is substantially aligned with a focal point of the second FSS.

9. The system of claim 1, further comprising a first frequency selective surface (FSS) operative to pass RF signals within the first frequency band and reflect RF signals within the second frequency band and a second FSS operative to reflect RF signals within the second frequency band, the first FSS having a flat circular shape that is disposed between the first feedhorn cluster and the sub-reflector such that the radiating aperture's phase center of the first feedhorn cluster is substantially aligned with the second focal point of the sub-reflector, and the second FSS having a generally ellipsoidal shape that is disposed between the second feedhorn cluster and the sub-reflector such that the radiating apertures phase center of the second feedhorn cluster is substantially aligned with a first focal point of the second FSS and a second focal point of the second FSS is substantially aligned with the second focal point of the sub-reflector via a reflective point of the first FSS.

10. The system of claim 1, wherein the first frequency band is the Ka band and the second frequency band is the X band.

11. An antenna system for a satellite, the system comprising:

a main reflector having a parabolic dish shape with a concave reflective surface;

a sub-reflector disposed above and spaced apart from the concave reflective surface of the main reflector with a first focal point aligned with a focal point of the main reflector;

a first feedhorn cluster that includes seven circular feedhorns with a central feedhorn and six outer feedhorns disposed around the periphery of the central feedhorn in a generally hexagonal arrangement, each of the seven circular feedhorns being operative to transmit and receive radio frequency signals within a first frequency band, the first feedhorn cluster extends through the concave reflective surface of the main reflector with its radiating aperture's phase center substantially aligned with a second focal point of the sub-reflector, wherein each of the seven circular feedhorns distribute the total power of an output signal through spatial combining of the plurality of feedhorns; and a second feedhorn cluster that includes five circular feedhorns with a central feedhorns and four outer feedhorns arranged in a generally X shaped configuration, the second feedhorn cluster being operative to transmit and receive radio frequency signals within a second frequency band, the second feedhorn cluster extends through the concave reflective surface of the main reflector with its radiating aperture's phase center substantially aligned with the second focal point of the sub-reflector, wherein the first frequency band includes frequencies greater than frequencies in the second frequency band.

12. The system of claim 11, further comprising a first traveling wave tube amplifier (TWTA) that provides a first in-phase input signal to the central feedhorn, a second TWTA that provides a second in-phase input signal to a first and second feedhorn of the six outer feedhorns, a third TWTA that provides a third in-phase input signal to a third and fourth feedhorn of the six outer feedhorns, and a fourth TWTA that provides a fourth in-phase input signal to a fifth and sixth feedhorn of the six outer feedhorns.

13. The system of claim 11, wherein the sub-reflector is comprised of a first frequency selective surface (FSS) operative to reflect RF signals within the first frequency band and a second FSS operative to reflect RF signals within the second frequency band, the first FSS is bonded to the second FSS to form an angle therebetween such that the first FSS is tilted relative to the second FSS.

14. The system of claim 13, wherein the radiating aperture's phase center of the first feedhorn cluster is substantially aligned with a focal point of the first FSS and the radiating aperture's phase center of the second feedhorn cluster is substantially aligned with a focal point of the second FSS.

15. The system of claim 11, further comprising a first frequency selective surface (FSS) operative to pass RF signals within the first frequency band and reflect RF signals within the second frequency band and a second FSS operative to reflect RF signals within the second frequency band, the first FSS having a flat circular shape that is disposed between the first feedhorn cluster and the sub-reflector such that the radiating aperture's phase center of the first feedhorn cluster is substantially aligned with the second focal point of the sub-reflector, and the second FSS having a generally ellipsoidal shape that is disposed between the second feedhorn cluster and the sub-reflector such that the radiating apertures phase center of the second feedhorn cluster is substantially aligned with a first focal point of the second FSS and a second focal point of the second FSS is substantially aligned with the second focal point of the sub-reflector via a reflective point of the first FSS.

16. A method for forming an antenna system comprising:

arranging a plurality of first feedhorns operative to transmit and receive radio frequency signals within a first frequency band as a first feedhorn cluster that provides for power distribution for receiving and transmitting signals within the first frequency band;

arranging a plurality of second feedhorns operative to transmit and receive radio frequency signals within a second frequency band as a second feedhorn cluster that provides for power distribution for receiving and transmitting signals within the second frequency band;

locating the first feedhorn cluster at a surface of a main reflector with its radiating aperture's phase center substantially aligned with a second focal point of a sub-reflector that is disposed above and spaced apart from a concave reflective surface of the main reflector with a first focal point of the sub-reflector substantially aligned with a focal point of the main reflector; and locating second feedhorn cluster at the surface of the main reflector with its radiating aperture's phase center substantially aligned with the second focal point of the sub-reflector and spaced apart from the first feedhorn cluster.

17. The method of claim 16, further comprising providing the sub-reflector comprised of a first frequency selective surface (FSS) operative to reflect RF signals within the first frequency band and a second FSS operative to reflect RF signals within the second frequency band, and bonding the first FSS to the second FSS to form an angle therebetween such that the first FSS is tilted relative to the second FSS.

18. The method of claim 17, wherein the locating the first feedhorn cluster at a surface of a main reflector with its radiating aperture's phase center substantially aligned with the second focal point of the sub-reflector comprises aligning the first feedhorn cluster with a second focal point of the first FSS, and the locating the second feedhorn cluster at a surface of a main reflector with its radiating aperture's phase center substantially aligned with the second focal point of a sub-reflector comprises aligning the second feedhorn cluster with a second focal point of the second FSS.

19. The method of claim 16, further comprising:

locating a first frequency selective surface (FSS) having a generally flat circular shape operative to pass RF signals within the first frequency band and reflect RF signals within the second frequency band between the first feedhorn cluster and the sub-reflector such that the radiating aperture's phase center of the first feedhorn cluster is substantially aligned with the second focal point of the sub-reflector; and locating a second FSS having a generally ellipsoidal shape operative to reflect RF signals within the second frequency band between the second feedhorn cluster and the sub-reflector such that the radiating apertures phase center of the second feedhorn cluster is substantially aligned with a first focal point of the second FSS and a second focal point of the second FSS is substantially aligned with the second focal point of the sub-reflector via a reflective point of the first FSS.

20. The method of claim 16, wherein the arranging a plurality of first feedhorns comprises arranging six outer feedhorns disposed around the periphery of a central feedhorn in a generally hexagonal arrangement.

* * * * *